US011969634B2

(12) United States Patent
Pegnatori

(10) Patent No.: US 11,969,634 B2
(45) Date of Patent: Apr. 30, 2024

(54) BAT APPARATUS

(71) Applicant: Carl Pegnatori, Yucaipa, CA (US)

(72) Inventor: Carl Pegnatori, Yucaipa, CA (US)

( * ) Notice: Subject to any disclaimer, the term of this patent is extended or adjusted under 35 U.S.C. 154(b) by 520 days.

(21) Appl. No.: 17/187,793

(22) Filed: Feb. 27, 2021

(65) Prior Publication Data

US 2021/0197045 A1 Jul. 1, 2021

Related U.S. Application Data

(60) Provisional application No. 62/954,368, filed on Dec. 27, 2019.

(51) Int. Cl.

| | |
|---|---|
| ***A63B 60/54*** | (2015.01) |
| ***A63B 59/54*** | (2015.01) |
| ***A63B 59/58*** | (2015.01) |
| ***A63B 60/16*** | (2015.01) |

(52) U.S. Cl.

CPC ..... *A63B 60/54* (2015.10); *A63B 59/54* (2015.10); *A63B 59/58* (2015.10); *A63B 60/16* (2015.10); *A63B 2209/00* (2013.01)

(58) Field of Classification Search

CPC ..... A63B 60/54; A63B 59/54; A63B 59/58; A63B 60/16; A63B 2209/00; A63B 59/56; A63B 60/002; A63B 60/14

See application file for complete search history.

(56) References Cited

U.S. PATENT DOCUMENTS

| | | | | |
|---|---|---|---|---|
| 2008/0081711 | A1* | 4/2008 | Chauvin | A63B 60/00 473/519 |
| 2015/0105189 | A1* | 4/2015 | Schullstrom | A63B 59/50 473/567 |

* cited by examiner

*Primary Examiner* — Jeffrey S Vanderveen

(74) *Attorney, Agent, or Firm* — Foundation Law Group LLP; Sevag Demirjian; J D Harriman

(57) ABSTRACT

The system provides an improved and durable bat, that is also resistant to vibration, while still maximizing performance characteristics. In one embodiment, a thermal heat shrink to encase the bat with a more durable, crack and chip resistant outer layer. In one embodiment, polyolefin is used as the heat shrink materials. The heat shrink material also reduces vibration effects significantly.

8 Claims, 6 Drawing Sheets

BAT APPARATUS

This patent application claims priority to U.S. Provisional Patent Application 62/954,368 filed on Dec. 27, 2019, the entirety of which is incorporated by reference herein.

BACKGROUND OF THE SYSTEM

Baseball and softball bats (hereafter "bats") are currently made from aluminum alloys, composite materials, or some combination thereof. The bats are tubular (hollow inside) and have a relatively narrow handle and a larger barrel which is the striking surface. Current bat technology suffers from a number of disadvantages. One disadvantage is the excessive wear and tear that results from normal use, leading to cracking, chipping, and the like. When bats become too worn, they can be deemed illegal in sanctioned play. Another disadvantage of prior art bats is excessive vibration. In normal use, the batter may feel a buzzing in the arms at contact. This is known colloquially as "bees in the bat" and is an unpleasant feeling, and affects performance as well.

One prior art attempt to improve durability is to develop flexible shells of the bat by redesigning the composition of the bat. Another attempt is to use more durable clear coatings in an attempt to prevent damage to the actual material of the bat while the clear coat is in place. The durable composition material may be at odds with bat performance, resulting in a compromise between durability and performance. In addition, the bats still develop cracks, seam splits, and chips. Such damage may render the bat illegal for use in sanctioned play.

Attempts to cure the vibration of the bat have included the use of dampening materials such as sorbothane, silicone, rubber, cork and other vibration dampening materials. These solutions have yet to sufficiently reduce vibration of the bat upon impact with the ball.

SUMMARY

The system provides an improved and durable bat, that is also resistant to vibration, while still maximizing performance characteristics. In one embodiment, a thermal heat shrink to encase the bat with a more durable, crack and chip resistant outer layer. In one embodiment, polyolefin is used as the heat shrink materials. The heat shrink material also reduces vibration effects significantly. In one embodiment, the bat itself incudes polyolefin layers as part of its construction, in addition to a polyolefin layer on the outer surface of the bat. In one embodiment, logos and other graphical information can be applied using the shrink wrap layer, obviating the need for painting and other graphical applications, improving the efficiency of bat production.

DETAILED DESCRIPTION OF THE SYSTEM

The system adds a shrink wrap material to a bat to improve appearance, performance, and durability. The bat may be designed to maximize performance, without the need to balance performance and durability. The durability is proved by the application of a shrink wrap material to the bat. In addition to providing durability, the shrink wrap material also provides appearance advantages.

In the prior art, paint is often applied to a bat for appearance purposes. This may be to identify the type of bat, the manufacturer, and/or the team or player using the bat. This is a multistep process comprising prepping, painting, curing, and decal application. This adds to the complexity of bat manufacture, and introduces another possible point of failure that can render a bat unusable during the production process.

Currently bats can only be painted and cured at certain (high) temperatures and conditions. The process requires many steps to prepare the bat for painting, to paint the bat and/or apply decals, and to cure the paint/decals. One problem with current techniques is that it is difficult to know for certain if the paint or decals have cured properly.

Even after production, paint adhesion remains a problem during normal use of the bat. The logos are marred over time and become unreadable, and the materials used are still subject to cracking and chipping.

The current system uses a shrink wrap material as an end step in the bat manufacturing process. In one embodiment, color, logos, and/or graphic images may be pre-printed on the shrink wrap material. Such printing is well understood and is resistant to damage, fading, cracking, tearing, and other problems associated with current approaches. The use of the shrink wrap material allow for protection and decoration to be accomplished in a single step. There are no issues with curing, and the performance of the bat is not impacted by the need for prepping for painting or other processes.

Unwanted vibration has also been an ongoing problem for batters. Vibrations are a transfer of energy in an inefficient manner that detracts from bat performance. In addition, the vibration may cause stinging in the hands of the batter, which will impact the batter's performance during play. The batter may be hesitant to swing as hard on subsequent pitches because of the fear of additional stinging. The present system solves that problem with the application of shrink wrap material to the bat.

Some bats use Floating Inner Barrel (FIB) technology, such as that described in U.S. Pat. No. 9,005,056 which is incorporated by reference herein in its entirety. This may increase the vibration problem noted above. In one embodiment, the inner barrel insert is encased in a shrink wrap material to insulate it and to prevent the hard surface of the insert from directly contacting the inside of the bat barrel. This has drastically reduced vibration.

Figure 1:
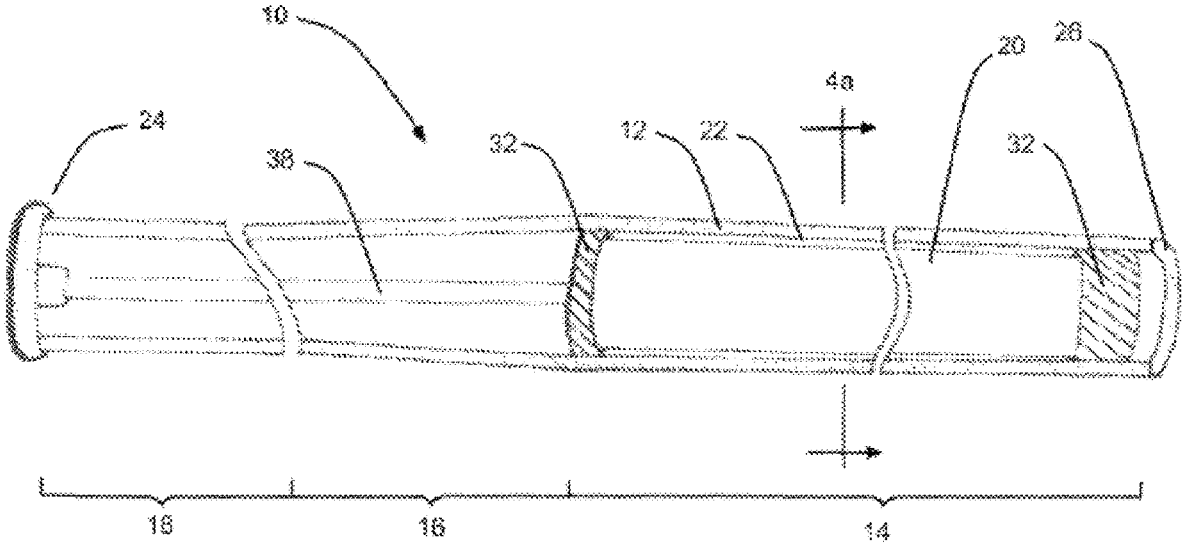
FIG. 1 illustrates an FIB construction of a bat.

An example of an FIB bat is illustrated in FIG. 1. This embodiment discloses bat 10 comprising of frame 12 that contains a relatively large-diameter hitting portion 14, an intermediate tapering portion 16, and a relatively small-diameter handle portion 18. A knob 24 closes the opening at handle portion 18. Tube 38 is attached to knob 24 and extends through handle portion 18, tapering portion 16, and through insert 20. Foam 32 is a high-density foam that has a diameter greater than the diameter of insert 20, is longer than insert 20, and along its axis contains channel 34. Foam 32 is compressed and then inserted into insert 20. Tube 38 is then passed through channel 34. Cap 26 closes the opening at hitting portion 14. Tube 38 positions insert 20 so that it will not come into contact with frame 12 when the bat is at rest; allowing insert 20 to freely move within the hitting portion 14 to both absorb energy by elastic deformation and to dampen vibrations by compressing against the wall of hitting portion 14 on the side opposite to the point of impact.

The insert may be of any suitable shape such as shown in U.S. Pat. No. 9,005,056 and in pending application Ser. No. 16/733,232 which is incorporated by reference herein in its entirety. In addition, the insert may be single wall or double wall.

Figure 2:
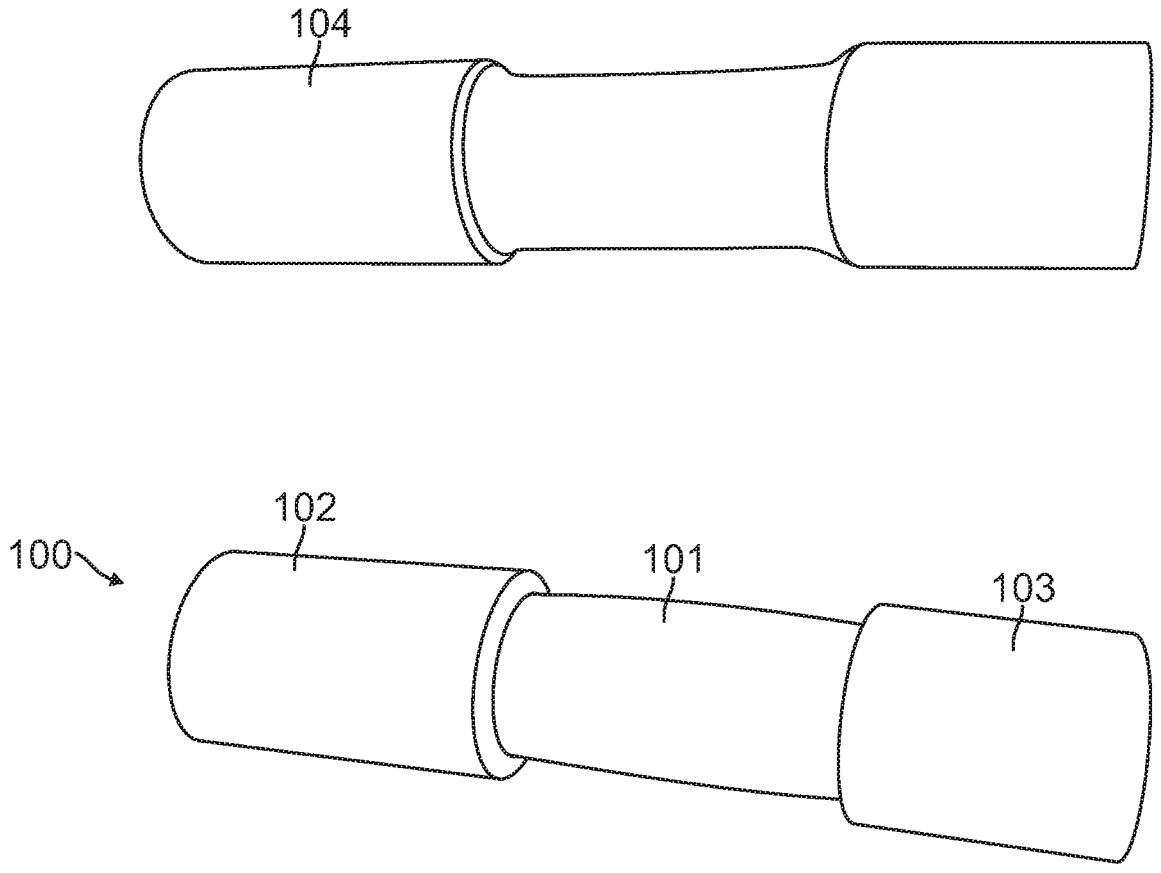
FIG. 2 illustrates the system used with an FIB in an embodiment.

FIG. 2 illustrates before and after images of an embodiment of the system applied to FIB technology. FIB insert 100 comprises an inner barrel 101 with foam sections 102 and 103 used to float the inner barrel 101 within the barrel of a bat. The entire assembly is covered with a shrink wrap material 104 as shown in the upper portion of FIG. 1. The shrink wrap coating provides a dampening effect on vibrations as well as providing durability to the FIB assembly. The shrink wrap is applied by heating the shrink wrap material, causing it to contract and form tightly to the insert.

Figure 4:
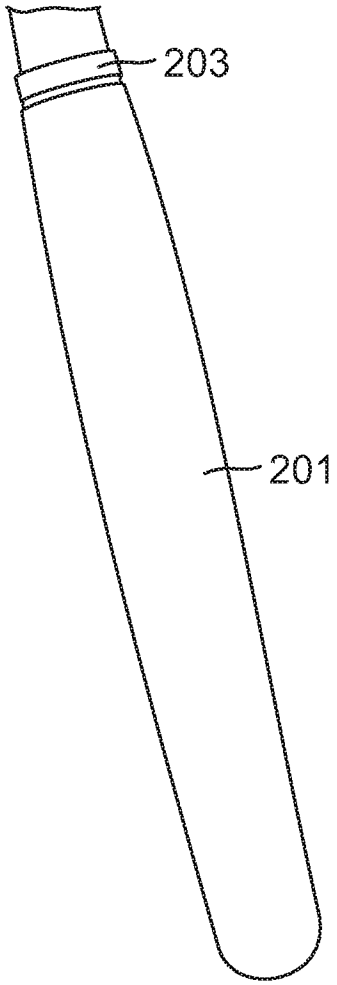
FIGS. 3 and 4 illustrate the system used on a bat barrel in an embodiment.
Figure 3:
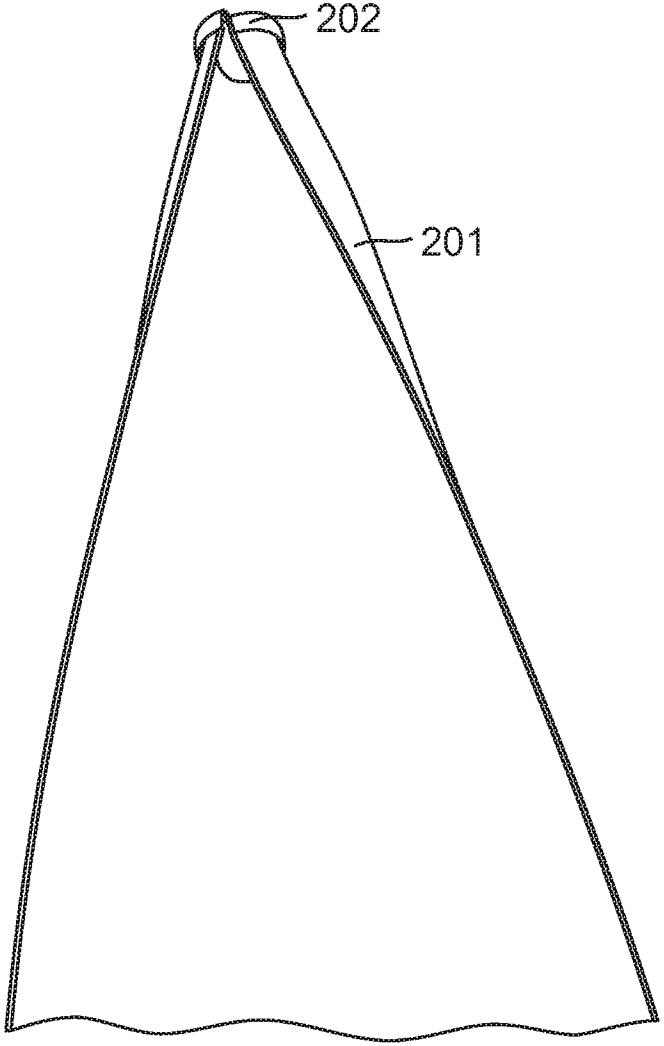
Figure 8:
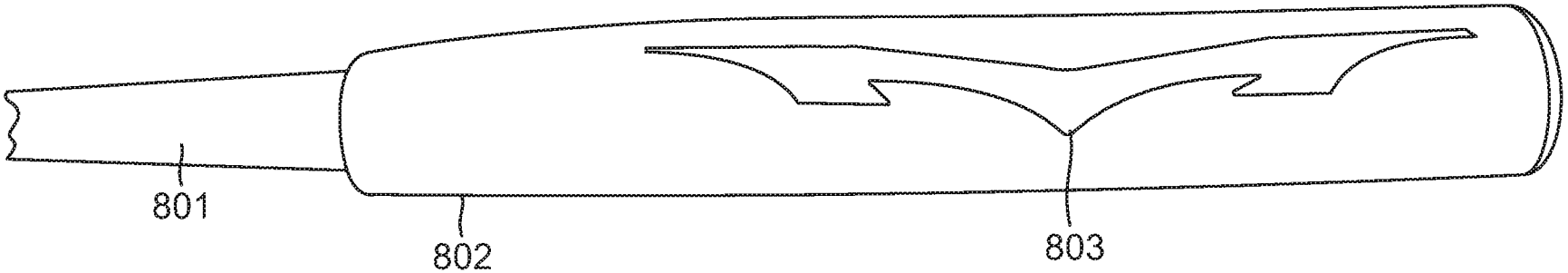
FIG. 8 illustrates a bat where a logo is pre-printed on the shrink-wrap material prior to being applied to the bat.

FIGS. 3 and 4 illustrates the system used on the barrel of a bat in an embodiment. The bat may be of any type, including metal or wood. Referring first to FIG. 3, the shrink wrap material 201, such as polyolefin in one embodiment, is formed into a tube shape and includes a ring 202 at one end. The shrink wrap material may have a logo and/or other graphics formed therein already as shown in FIG. 8. The bat 801 has a shrink wrap material 802 applied to the barrel and the material 802 has a pre-printed logo 803 applied thereon. The shrink wrap material itself may be of any desired color or colors. In one embodiment, the shrink wrap may be applied first and then a decal may be applied to the shrink wrap. The decal adheres better to the shrink wrap material than to the bat barrel.

The shrink wrap material is applied to bat 203 (FIG. 4) and heated, causing the material to seal to that bat and to itself, eliminating the seam. The bat is now complete with no need for a prepping, painting, and curing step, simplifying bat production.

Figure 5:
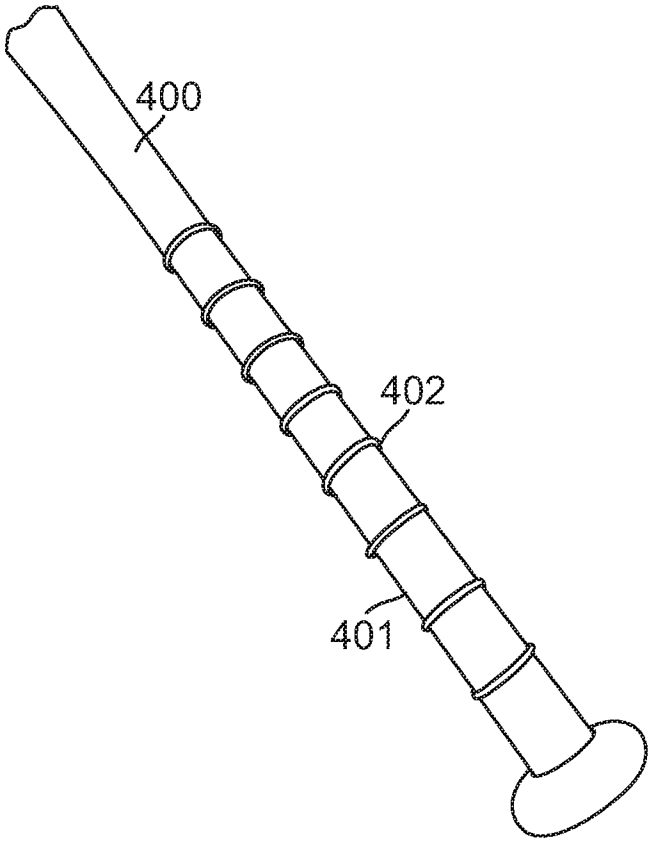

In some cases, a batter prefers a grip to be added to the bat for more secure handling. In the past this has been accomplished using tape or other adhesive material, or by forming a grip material and stretching it onto the handle of the bat. Such prior art grips wear out, can be loose, and do not perform as intended. In an embodiment of the system, a bat 400 having a handle 401 is prepared (FIG. 5) by applying a series of rings 402 to the handle 401. The rings may be affixed via adhesive or simply by elastic pressure. The rings will be held in place by action of the shrink wrap material when the material is added to the handle.

Figure 6:
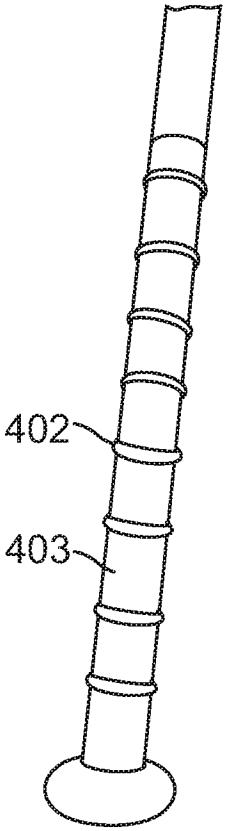
FIGS. 5 and 6 illustrates the system used on a handle in an embodiment.

Subsequently (FIG. 6) a shrink wrap material 403 is placed over the handle and heat treated to shrink to the handle. The rings 402 create a knurled surface that improves the ability to grip the bat.

Figure 7:
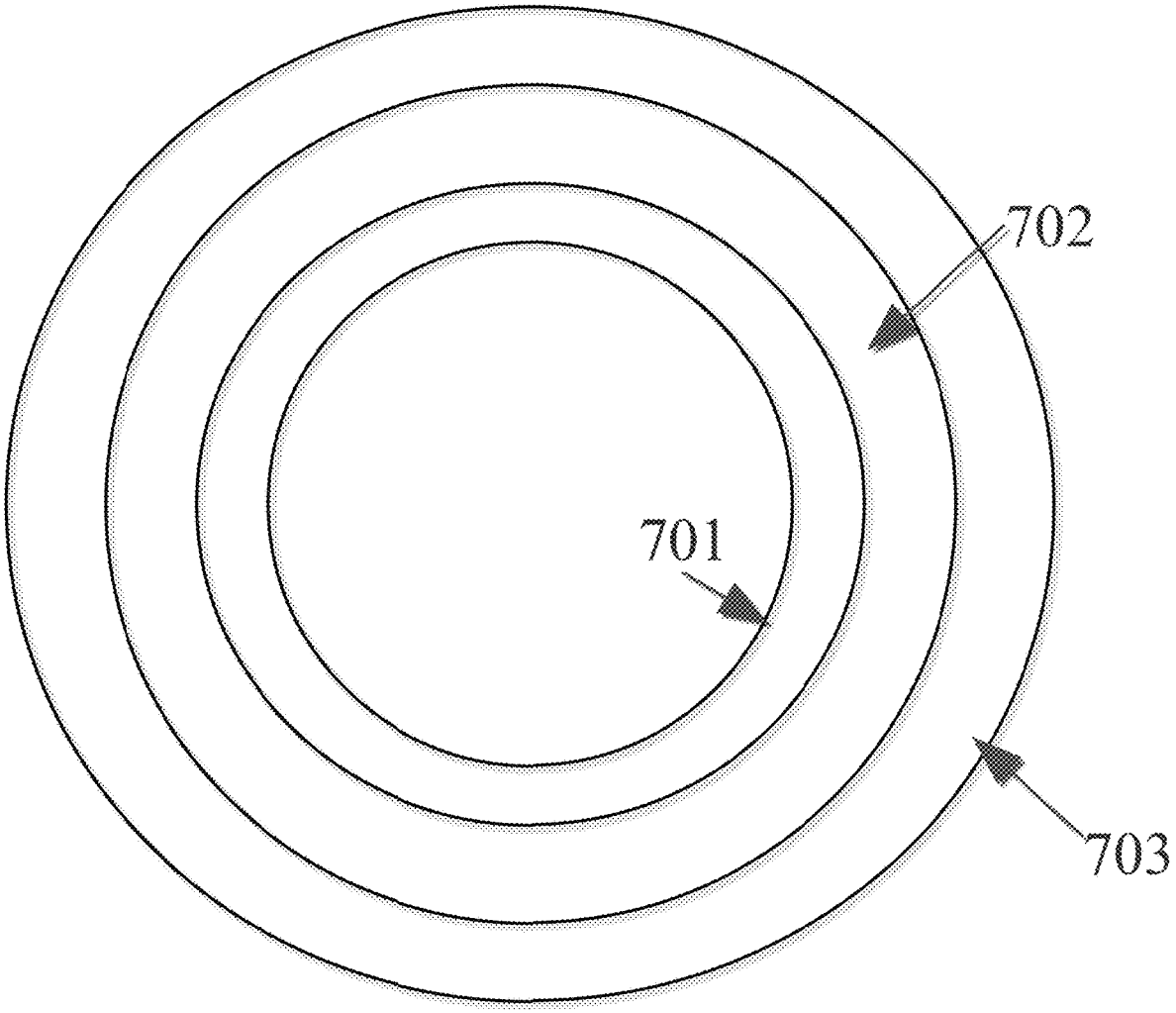
FIG. 7 illustrates the use of a polyolefin layer as part of the wall of the bat itself.

In embodiment, the bat may be constructed by forming a plurality of layers on a substrate. The bat can be constructed with one or more layers of polyolefin and one or more layers of thermoset resins, for example. FIG. 7 illustrates an embodiment of a barrel of a bat comprised of multiple layers. The bat comprises a substrate layer 701 surrounded by at least one polyolefin layer 702. The polyolefin layer 702 is surrounded by one or more outer layers comprising a thermoset material. The entire barrel may then be covered by a shrink wrap material as described above. The layers 702 and 703 may be multiple alternating layers as well.

Thus, an improved bat has been described.

What is claimed is:

1. A bat comprising:

a tubular frame having a circular cross-section, the tubular frame including a large diameter hitting portion, an intermediate tapering portion, and a small diameter handle portion; and a shrink wrap layer formed on a surface of the large diameter hitting portion, wherein the shrink wrap layer includes a ring formed at an end thereof.

2. The bat of claim 1 wherein the shrink wrap layer includes a preprinted logo formed thereon.

3. The bat of claim 1 wherein the shrink wrap layer comprises polyolefin.

4. The bat of claim 1 further including a tubular insert positioned within the large diameter hitting portion of the tubular frame such that there is a gap between the tubular insert and the tubular frame.

5. The bat of claim 4 wherein the tubular insert further includes a shrink wrap layer formed on a surface of the insert.

6. The bat of claim 1 wherein the tubular frame from is comprised of a substrate and a plurality of polyolefin and thermosetting layers.

7. A bat comprising:

a tubular frame having a circular cross-section, the tubular frame including a large diameter hitting portion, an intermediate tapering portion, and a small diameter handle portion;

a shrink wrap layer formed on a surface of the large diameter hitting portion; and a tubular insert positioned within the large diameter hitting portion of the tubular frame such that there is a gap between the tubular insert and the tubular frame wherein the tubular insert further includes a shrink wrap layer formed on a surface of the insert.

8. A bat comprising:

a tubular frame having a circular cross-section, the tubular frame including a large diameter hitting portion, an intermediate tapering portion, and a small diameter handle portion; and a plurality of rings formed on a surface of the small diameter handle portion, a shrink wrap layer formed on a surface of the small diameter handle portion.

* * * * *